United States Patent [19]

Cribiu' et al.

[11] Patent Number: 4,560,070

[45] Date of Patent: Dec. 24, 1985

[54] DEVICE FOR SEPARATION OF SPRUES FROM MOLDED PIECES OF DIFFERENT SHAPES AND SIZES

[75] Inventors: Oreste Cribiu', Turate; Leonardo Cribiu', Saronno, both of Italy

[73] Assignee: Crizaf di O. & L. Cribiu' S.n.c., Saronno, Italy

[21] Appl. No.: 537,435

[22] Filed: Sep. 30, 1983

[30] Foreign Application Priority Data

Oct. 6, 1982 [IT] Italy ..... 23637 A/82

[51] Int. Cl.[4] ..... B07B 1/22

[52] U.S. Cl. ..... 209/664; 209/288; 209/394

[58] Field of Search ..... 209/44.3, 288, 392–395, 209/656, 660, 664, 673, 675, 666, 676, 680, 683, 687, 668

[56] References Cited

U.S. PATENT DOCUMENTS

| | | | |
|---|---|---|---|
| 19,768 | 3/1858 | Garretson | 209/664 |
| 1,025,791 | 5/1912 | Donges | 209/394 |
| 2,484,318 | 10/1949 | Smith | 209/394 |

FOREIGN PATENT DOCUMENTS

| | | | |
|---|---|---|---|
| 153285 | 11/1903 | Fed. Rep. of Germany . | |
| 260373 | 9/1912 | Fed. Rep. of Germany . | |
| 304686 | 7/1916 | Fed. Rep. of Germany . | |
| 2756172 | 6/1979 | Fed. Rep. of Germany . | |
| 2362692 | 3/1978 | France . | |
| 660318 | 2/1964 | Italy | 209/680 |

*Primary Examiner*—David A. Scherbel
*Assistant Examiner*—Donald T. Hajec
*Attorney, Agent, or Firm*—Yount & Tarolli

[57] ABSTRACT

This invention relates to an improved device for separation of sprues from molded pieces, comprising a substantially cylindrical drum element open on both bases, slanting and rotatably carried; the bases, comprising rings with rollers located at an adjustable distance from one another engaging thereon, provide sets of rollers arranged on different diameters to prearrange a passage zone for the pieces and risers or sprues to be separated.

5 Claims, 3 Drawing Figures

FIG.1
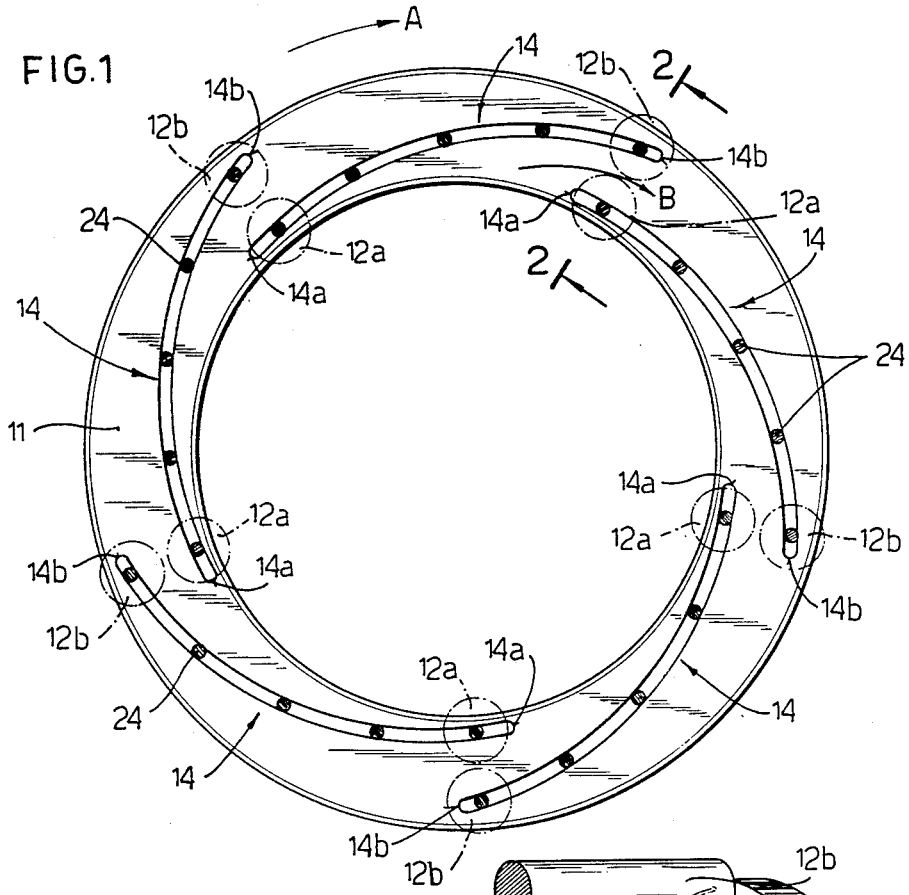
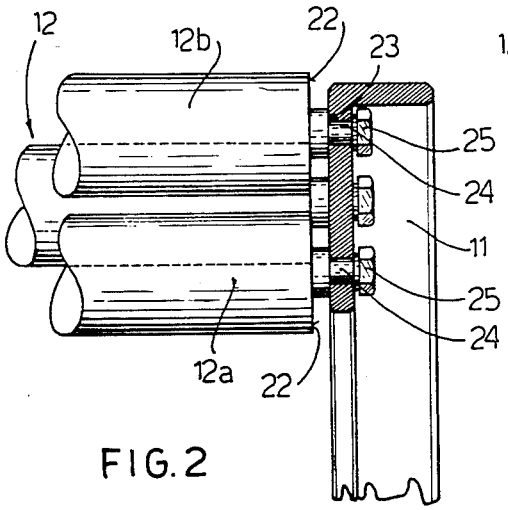
FIG.2
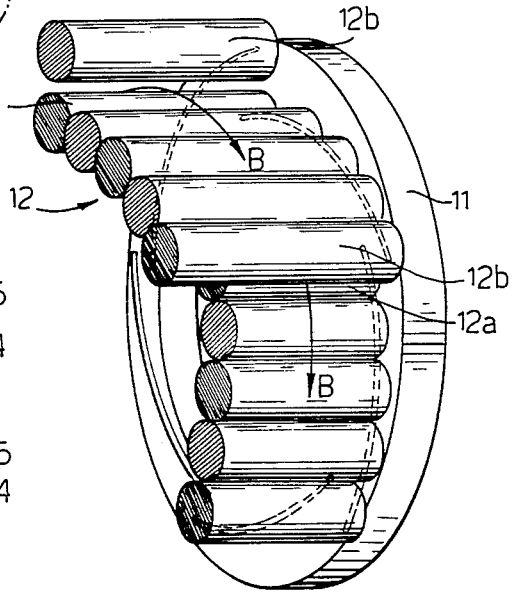
FIG.3

DEVICE FOR SEPARATION OF SPRUES FROM MOLDED PIECES OF DIFFERENT SHAPES AND SIZES

This invention relates to an improved device for separation of sprues or risers that is solidified scrap material obtained during molding preparation, from relative molded pieces of different shapes.

In order to carry out said separation, cylindrical separators are at present provided, the bases of which comprise two rings supporting fixed or rotatable cylindrical rollers, on a circumference and forming the side surface through which part of the intended separation occurs. Said cylindrical separators are rotatably carried so as to discharge the elements to be separated from the bottom and one end of the open ends. However, the prior art separators have some problems in separating substantially flat pieces, such as for example half-elements forming the minicassette containers.

Therefore, it is the object of the present invention to provide a separator device, in which rollers are provided as forming the side surface and so arranged that during rotation a covering zone is created for the discharge of said substantially flat pieces which are not ordinarily effectively separated by known separators.

The above object is achieved providing that adjacent rollers engage with the rings at different diameters to create a covering zone for the piece passage.

A particular embodiment contemplates the provision of a plurality of grooves, arranged inclined transversely of the width of said rings, having one end adjacent the edge corresponding to the larger diameter of the ring and the other end adjacent to the edge corresponding to the smaller diameter of the ring, all of which oriented in the same direction, so that end portion of one groove at least partially overlies the initial portion of the adjacent groove. This enables the relative mutual distance or spacing of the rollers forming the side surface to be adjusted. Of course, the device shall rotate in the same direction in which said grooves are oriented.

A preferred solution provides that said ends of said grooves are joined or connected by a curved, preferably concave, line.

A particular embodiment provides that each of said rollers have at least an end portion bearing against the surface of the ring adjacent to the groove and that a threaded projecting portion is inserted in said groove and cooperates with the other end by a suitable female thread means.

A preferred embodiment of the invention will now be described with reference to the accompanying drawing, in which:

FIG. 1 is a plan view showing an embodiment for a ring according to the improvement provided by the present invention;

FIG. 2 is a sectional view showing the engagement with the rollers; and

FIG. 3 is a partial perspective view showing the passage or discharge zone for the molded pieces.

A separator device according to the invention comprises a substantially cylindrical drum open or both sides and carried by a vertically overlying bearing structure for the positioning of a container for the separated pieces therebelow. Said drum is not shown as a whole as being already known to those skilled in the art. By known means it can also be inclined as required. It can also be rotatably driven by well known means in the reach of anyone skilled in the art.

On the other hand, the mutual arrangement of the rollers is suitably designed for creating a discharge passage with a conveying zone for particularly shaped pieces. It is particularly desired to provide for positioning of adjacent rollers on different diameters.

FIG. 1 is a view showing the manufacture for the rings 11 supporting the rollers 12 according to the improvement as provided by the present invention. Each of said rings 11 has grooves 14 developing across the ring width and have one end 14*a* adjacent to the edge of smaller diameter and the other end 14*b* adjacent to the edge of larger diameter. Said grooves have the rollers 12 positioned therein at a distance or spacing as required. When the drum is assembled, the two rings 11 have grooves 14 parallely disposed. It is particularly important that all of these grooves are oriented in a same direction, as shown in FIG. 1, and that, by this orientation, the roller is rotatably driven in the direction of arrow A.

A discharging zone is determined by adjacent rollers 12*a* and 12*b*, but arranged on different adjacent grooves, the mutual distance or spacing of said rollers 12*a* and 12*b* being set by the position of the adjacent grooves 14 of FIG. 1. It clearly appears that by the drum rotation the pieces are outwardly forced by the centrifugal force and then conveyed to the passage zone B between said adjacent rollers 12*a* and 12*b*. As it will be seen, the end portion of said grooves 14 also partly overlies the initial portion of the adjoining groove. Instead of a continuous groove, openings of any shape could be provided.

A particular engaging means for the rollers is shown in FIG. 2. This means comprises a roller 12 which has an abutment 22, but anyhow having a portion 23 in contact with the ring. The roller terminates with a threaded projecting portion 24 engaging with the fastening knob 25. All of the other rollers in the groove are spaced apart as required. Of course, any known engaging means could be provided.

FIG. 3 is a fragmentary perspective view showing the passage zone B for the pieces, for example of substantially flat shape which, as above mentioned, are of particularly difficult separation.

For example, in rings having a diameter of 500 mm and rollers having a diameter of 50 mm, when providing five grooves as shown in FIG. 1, five rollers can be positioned for each groove with a total amount of 25 rollers. Of course, the pieces could be discharged through the zone between adjacent rollers arranged in the same groove 14.

It will be appreciated that this arrangement of adjacent rollers on different diameters advantageously enables the separation of pieces from the relative risers or sprues, as the passage zone is created at a suitable position owing to the centrifugal force provided by rotation.

The speed of rotation and inclination of the drum can be modified as required.

By this practical embodiment of the inventive separator device all of the intended objects can be achieved, and besides the intermediate roller which is required in standard known separators, can be eliminated.

What we claim is:

1. A device for separating first molded pieces from second molded pieces, said devices comprising a rotatable drum comprising two axially spaced end rings defining end openings through which the molded pieces are loaded into the drum, a plurality of sets of parallel rollers extending between said end rings, the rollers in each set being circumferentially spaced from each other to provide openings through which one of said first or second molded pieces can be ejected, each of said sets of rollers comprising a leading roller located adjacent the outer circumference of said end rings and a trailing roller located adjacent the inner circumference of said end rings, the respective leading and trailing rollers of adjacent sets of rollers being spaced radially to define a radial gap therebetween through which said one of said first and second pieces can also be ejected, and means for supporting the rollers of each set of rollers for adjustment towards and away from each other in a circumferential direction to adjust said openings and for adjusting the circumferential position of the leading roller of one set relative to the trailing roller of the adjacent set, adjustment of the circumferential position of the leading roller of one set relative to the circumferential position of the trailing roller of an adjacent set effecting adjustment of the radial gap therebetween.

2. A device as set forth in claim 1 wherein said means for supporting the rollers comprises parallel grooves formed in said end rings, said grooves having leading and trailing ends located adjacent said outer and inner circumferences of said end rings, respectively.

3. A device as set forth in claim 2 wherein said grooves are concavely curved with respect to the centers of said end rings.

4. A device as set forth in claim 2 wherein each of said rollers has opposite end surfaces abutting the end surface of said end rings.

5. A device as set forth in claim 4 wherein said end surfaces of each of said rollers has axial threaded projections thereon for adjustably securing the roller in a respective groove.

* * * * *